US005442368A

United States Patent [19]

Harada et al.

[11] Patent Number: 5,442,368

[45] Date of Patent: Aug. 15, 1995

[54] AUTOMOBILE LOOP ANTENNA

[75] Inventors: Takuji Harada; Takashi Kido, both of Kanagawa, Japan

[73] Assignee: Harada Kogyo Kabushiki Kaisha, Tokyo, Japan

[21] Appl. No.: 163,122

[22] Filed: Dec. 6, 1993

Related U.S. Application Data

[63] Continuation of Ser. No. 899,232, Jun. 16, 1992, abandoned, which is a continuation of Ser. No. 410,292, Sep. 21, 1989, abandoned.

[30] Foreign Application Priority Data

Sep. 21, 1988 [JP] Japan ..... 63-236795

[51] Int. Cl.[6] ..... H01Q 1/32; H01Q 7/00

[52] U.S. Cl. ..... 343/713; 343/742; 343/744

[58] Field of Search ..... 343/712, 713, 741, 742, 343/744, 748; H01Q 1/32, 7/00, 11/12

[56] References Cited

U.S. PATENT DOCUMENTS

| | | | |
|---|---|---|---|
| 2,578,154 | 12/1951 | Shanklin | 343/744 |
| 3,641,576 | 2/1972 | Farbanish | 343/744 |
| 3,906,507 | 9/1975 | Allen | 343/742 |
| 4,080,603 | 3/1978 | Moody | 343/744 |
| 4,801,944 | 1/1989 | Madnick et al. | 343/741 |
| 4,823,141 | 4/1989 | Ohe et al. | 343/741 |

*Primary Examiner*—Michael C. Wimer
*Attorney, Agent, or Firm*—Koda and Androlia

[57] ABSTRACT

An automobile loop antenna including a conductive loop and a coaxial cable. One end of the loop is connected to a core conductor of the coaxial cable, and the other end of the loop is connected to an outer conductor of the coaxial cable with a low-capacitance capacitor in between. A part of the outer conductor of the coaxial cable is connected to a metal part of an automobile so that the end of the coaxial cable is spaced 5 to 50 cm from the metal part.

4 Claims, 2 Drawing Sheets

AUTOMOBILE LOOP ANTENNA

This is a continuation of application Ser. No. 07/899,232, filed Jun. 16, 1992, now abandoned, which is a continuation of application Ser. No. 410,292, filed Sep. 21, 1989, abandoned.

BACKGROUND OF THE INVENTION

1. Field of the Invention

The present invention relates to an automobile antenna and more particularly to an automobile loop antenna.

2. Prior Art

Conventionally, rod antennas have generally been used in automobiles. However, rod antennas may be unattractive from an aesthetic point of view. In other words, their external appearance sometimes does not match the particular style of automobile. Use of a rod antenna is also undesirable when considering wind noise generated by such an antenna when the vehicle is running at high speeds.

In order to insure stability of vehicle body during high-speed driving, recently it has become the practice to mount a flap (spoiler) at the rear of the vehicle. In addition, a diffuser plate, which can be used as a sun visor, may be installed above the windshield. Thus, an antenna which may be used along with these types of car accessories to impart a spoiler look to the vehicle has been in high demand.

SUMMARY OF THE INVENTION

The object of the present invention is to provide an AM/FM antenna which is not in a rod-form and does not generate any wind noise.

To achieve these objects, the antenna of the present invention is in a loop form wherein one end of a loop is connected to a central core conductor of a coaxial cable which sticks out of the vehicle body and the other end of the loop is connected to an outer conductor of the coaxial cable with a low-capacitance capacitor in between. The outer conductor of the coaxial cable is connected to a metal part of the automobile body at a point 5 to 50 cm away from the tip end of the coaxial cable.

Since the antenna of the present invention is designed so that one end of the loop is connected to the core conductor of the coaxial cable and the other end of the loop is connected to the outer conductor of the coaxial cable via the low-capacitance capacitor, the antenna is aesthetically desirable and generates no wind noise.

DETAILED DESCRIPTION OF THE INVENTION

Figure 1:
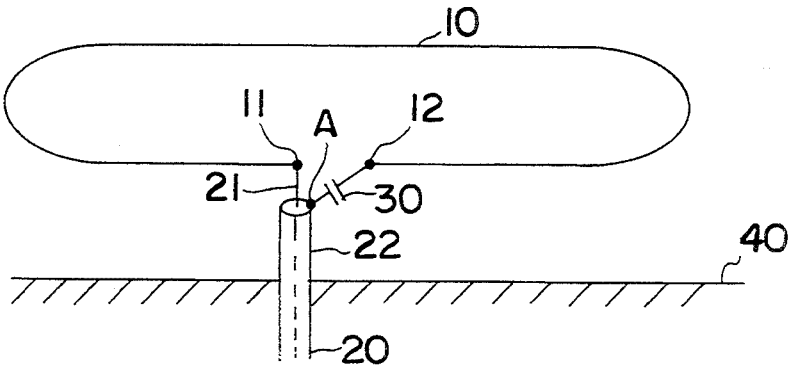
FIG. 1 is a perspective view of a first embodiment of the present invention.

Referring first to FIG. 1 which illustrates a first embodiment of the present invention, the antenna includes a conductive loop 10 in an oblong shape to resonate the FM wave band, a coaxial cable 20 provided in a vehicle body 40 which sticks out therefrom, and a low capacitance capacitor 30.

One end 11 of the loop 10 is connected to a central core conductor 21 of the coaxial cable 20, and the other end 12 of the loop 10 is connected to an outer conductor 22 of the coaxial cable 20. The low-capacitance capacitor 30 is provided between the end 12 of the loop 10 and the outer conductor 22. The vehicle body 40 does not need to be made of metal, and the outer surface of the outer conductor 22 of the coaxial cable 20 can be covered with an insulating film (not shown). It goes without saying that such insulating film can be omitted.

In operation, the conductive loop 10 is caused to resonate in the FM wave band. In other words, the loop 10 can resonate in a path, which is formed by the end 11, where the core conductor 21 and loop 10 are connected, the loop 10, the end 12 where the loop 10 is connected to the capacitor 30, and a point A where the capacitor 30 and outer conductor 22 are connected. In this way, the loop 10 resonates in the FM wave broadcast band.

Impedance of the loop 10 itself is conspicuously lower than the load impedance of the cable, etc. Thus, the loop 10 by itself cannot act as an antenna for the AM wave band. However, since the low-capacitance capacitor 30 is provided at the terminal of the loop 10, the central core conductor 21 and outer conductor 22 are isolated from each other. As a result, high impedance is obtained for the AM band, and the antenna can thus receive the AM band too. Since the frequency is high in the FM band and is close to the load impedance, there is no difficulty receiving the FM band.

The antenna described above can be installed as part of spoiler accessory. In this case, no projecting objects as will be exposed with rod form antennas. Such an arrangement is aesthetically desirable and additionally prevents generation of any wind noise when the vehicle is in motion.

Furthermore, when the above-described loop antenna is combined in a spoiler accessory, it is preferable to set the antenna so that the loop 10 is spaced at least 50 mm away from the automobile body 40. The longer the distance, the better the reception sensitivity. For example, if the sensitivity at a 50 mm separation is 0 dB, a 90 mm separation produces a sensitivity of approximately +3 dB, and a 200 mm separation produces a sensitivity of approximately +5 dB. In other words, the closer the loop antenna is provided to the automobile body 40, the more the efficiency of the antenna will drop. Accordingly, antenna efficiency improves if the antenna placed farther away from the body 40.

FIGS. 2, 3, 4 and 5 show other embodiments of the present invention.

Figure 2:
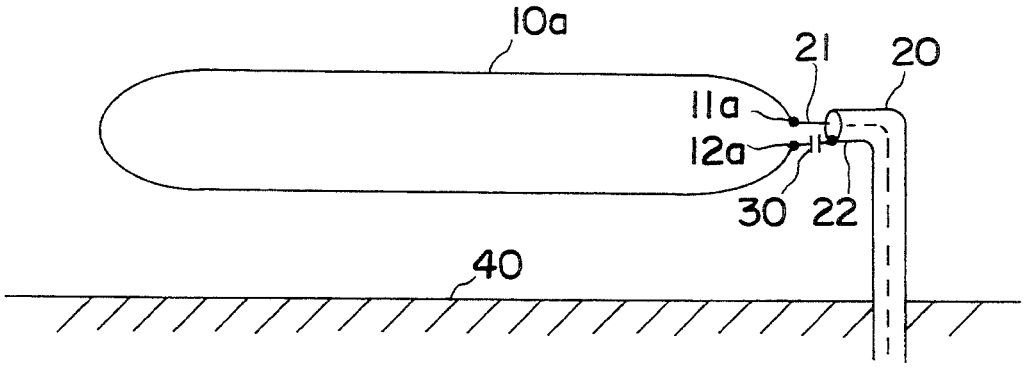
FIGS. 2, 3, 4 and 5 show modifications thereof.

In the above-described embodiment of FIG. 1, the coaxial cable 20 is connected to one of the longer sides of the oblong loop 10. In the embodiment of FIG. 2, the coaxial cable 20 is connected to one of the shorter sides of the loop 10. Like the first embodiment, AM and FM wave bands are received by the loop antenna of FIG. 2 with great sensitivity reliance.

Thus, when the loop 10 is installed at an inner end of the spoiler, the antenna of FIG. 2 better fits the shape of the spoiler. The antenna of FIG. 1 may also be used if the coaxial cable 20 is placed at the inside center of the spoiler.

Figure 3:
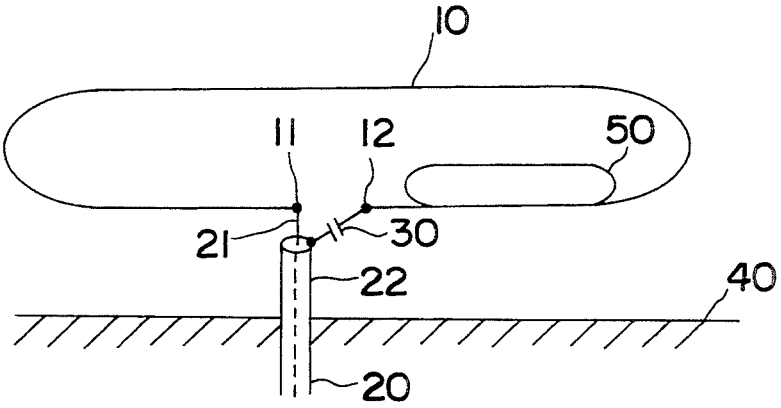

In the embodiment of FIG. 3, a second loop 50 is added to the loop 10 of FIG. 1. This second loop 50 is an auxiliary antenna and is used to broaden the FM reception band. The second loop 50 is formed using a part of the first loop 10 and is located inside the loop 50.

Figure 4:
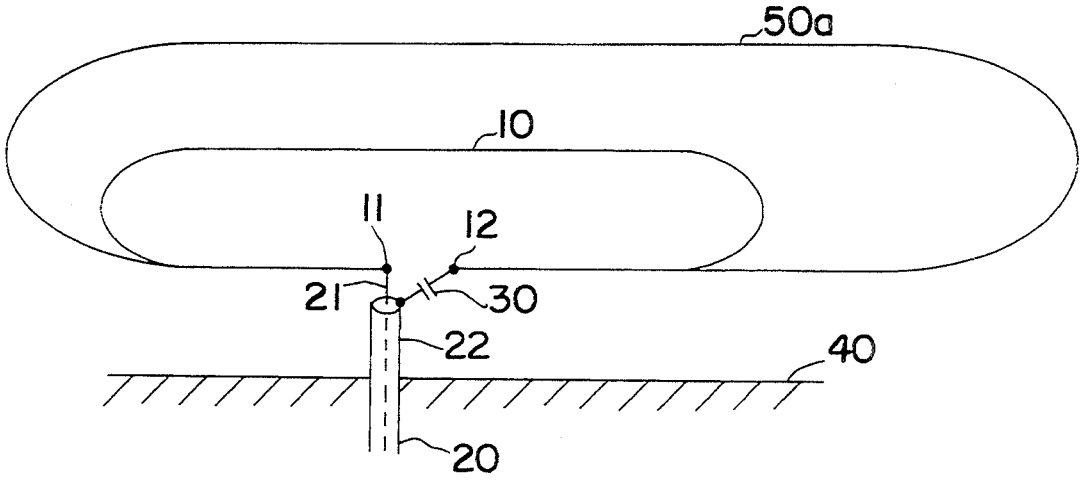
Figure 5:
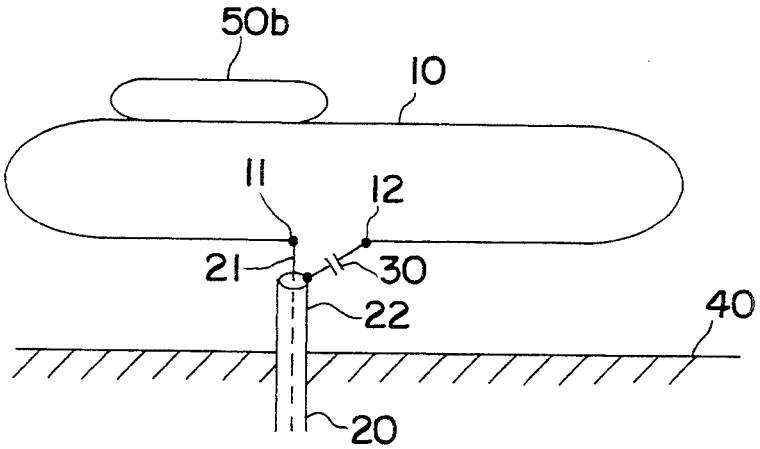

The antenna shown in FIG. 4 has a second loop 50*a* which is larger in diameter than the first loop 10 and provided around the first loop 10. In the antenna of FIG. 5, a second loop 50*b*, which is similar to the second loop 50 of FIG. 3, is provided outside of the first loop 10.

In the antennas of FIGS. 2, 4 and 5, the loops are connected to the coaxial cable 20 at the shorter side as shown in Figures.

Figure 6:
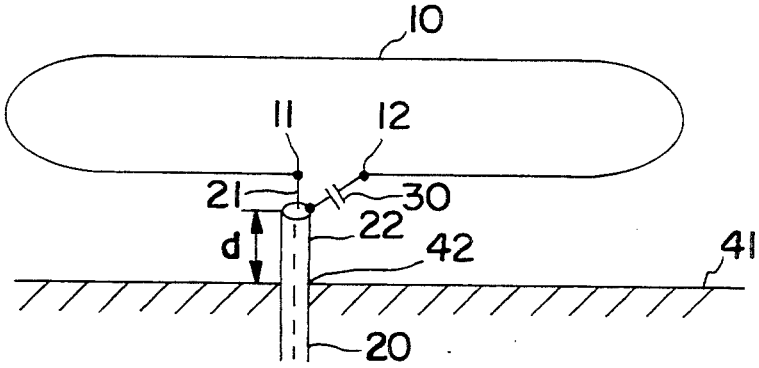
FIG. 6 is a perspective view of still another embodiment of the present invention.

The antenna shown in FIG. 6 is basically the same as the antenna of FIG. 1 except that the outer conductor 22 of the coaxial cable 20 is connected to the vehicle body 41, which is made of metal, at a point spaced away from the end (the upper end in the Figure) of the coaxial cable 20 by a predetermined distance d.

It is preferable to set the distance d, which is between the point 42, where the metal body 41 and the outer conductor 22 are connected, and the end of the coaxial cable 20, at 5 to 50 cm. In other words, it is preferable to form a space (between the point 42 and upper end of the coaxial cable 20) of 5 to 50 cm.

When the loop 10, which is the entire radiating part of the antenna, is connected to the coaxial cable 20 as shown in FIG. 6, the outer conductor 22 at the end of the coaxial cable 20 has an impedance at high frequencies as a result of floating from the metal body 41. Thus, it is preferable to ground the outer conductor 22.

However, in the embodiment of FIG. 6, the impedance of the outer conductor 22 is not reduced to zero by grounding the end of the outer conductor 22. Rather, a section of the outer conductor 22 which extends from the end of the coaxial cable 20 to the point of connection 42 is used positively as a part of the antenna. In other words, in addition to the loop 10 (which extends from the point of connection between the core conductor 21 of the coaxial cable 20 and the loop 10, and the low capacitance capacitor 30), the portion of the outer conductor 22 extending from the end of the coaxial cable 20 to the point of connection 42 and the metal body 41 are used as parts of the antenna which is caused to resonate in the reception bands. As a result of this arrangement, reception efficiency can be improved.

Furthermore, the distance d shown in FIG. 6 can vary depending upon the length of the loop 10, the capacitance of the capacitor 30, and installation conditions of the loop 10, capacitor 30 and metal body 41. It is desirable that a distance which produces maximum reception sensitivity be set as the distance d based on these conditions.

The concept of connecting a middle part of the outer conductor 22 to the body 41 as described above is what makes the present invention different from conventional antennas. More specifically, in conventional antennas it is necessary to eliminate the relationship between the level transmitted to the cable end on the receiver side and the reception current flowing through the outer conductor of the cable. For this reason, in conventional antennas, the outer conductor of the coaxial able is not grounded at its middle point. However, since the reception signal current generated in the outer conductor 22 cannot be ignored, maximum sensitivity is only obtained by appropriately selecting the location of the contact point 42.

In the antenna shown in FIG. 6, the loop 10 and the coaxial cable 20 may be connected in the same manner as shown in FIG. 2; that is, at the shorter side of the oblique loop 10. Furthermore, it is also possible to add a second loop 50, 50*a* or 50*b* shown in FIG. 3, 4 or 5, respectively, to the antenna of FIG. 6.

In the above described embodiments, the capacitance of the capacitor 30 is set at 10 PF. However, this capacitance may be set at any value in the range of 1 to 30 PF.

Furthermore, the loop antenna of the present invention may be mounted on the window of an automobile, i.e. on the rear window, side window or front windshield, etc. or other places.

As described in detail in the above, the present invention provides an aesthetically desirable antenna which generates no wind noise and is able to receive AM and FM bands reliably and with high sensitivity.

We claim:

1. An AM/FM broadcast band automobile loop antenna provided externally of an automobile body characterized in that one end of a loop is connected to a core conductor of a coaxial cable, the other end of said loop is connected to an outer conductor of said coaxial cable via a capacitor, said capacitor having a value of capacitance such that an impedance of said capacitor at the AM broadcast band isolates said core conductor from said outer conductor of said coaxial cable while an impedance of said capacitor at the FM broadcast band is substantially equal to a load impedance of the coaxial cable, said loop being sized to be resonant in the FM broadcast band and not resonant in the AM broadcast band, said outer conductor of said coaxial cable is connected to a metal part of an automobile at a point and a distance from said point where said outer conductor of said coaxial cable is connected to a metal part of said automobile to a point where said core conductor of said coaxial cable is connected to said end of said loop is 5 to 50 cm.

2. An automobile loop antenna according to Claim 1, wherein said capacitance of said capacitor is 1 to 30 PF.

3. An automobile loop antenna according to Claim 1 further comprising a closed second loop smaller in diameter than said loop connected in parallel to said loop, said second loop being inside of said loop.

4. An automobile loop antenna according to Claim 1 further comprising a closed second loop smaller in diameter than said loop connected in parallel with said loop and provided outside of said loop.

* * * * *